US007008295B2

(12) United States Patent
Wiswesser et al.

(10) Patent No.: US 7,008,295 B2
(45) Date of Patent: Mar. 7, 2006

(54) SUBSTRATE MONITORING DURING CHEMICAL MECHANICAL POLISHING

(75) Inventors: Andreas Norbert Wiswesser, Mountain View, CA (US); Manoocher Birang, Los Gatos, CA (US); Boguslaw A. Swedek, Cupertino, CA (US)

(73) Assignee: Applied Materials Inc., Santa Clara, CA (US)

( * ) Notice: Subject to any disclaimer, the term of this patent is extended or adjusted under 35 U.S.C. 154(b) by 19 days.

(21) Appl. No.: 10/358,852

(22) Filed: Feb. 4, 2003

(65) Prior Publication Data

US 2004/0152396 A1 Aug. 5, 2004

(51) Int. Cl.
*B24B 49/00* (2006.01)

(52) U.S. Cl. ..... 451/6; 451/5; 451/285; 156/636.1; 437/7

(58) Field of Classification Search ..... 451/5, 451/6, 7, 285–290; 156/636.1, 626; 437/7, 437/225

See application file for complete search history.

(56) References Cited

U.S. PATENT DOCUMENTS

| | | | | |
|---|---|---|---|---|
| 5,081,796 | A | | 1/1992 | Schultz |
| 5,196,353 | A | | 3/1993 | Sandhu |
| 5,433,651 | A | | 7/1995 | Lustig et al. |
| 5,486,129 | A | | 1/1996 | Sandhu |
| 5,605,760 | A | | 2/1997 | Roberts |
| 5,609,511 | A | | 3/1997 | Moriyama et al. |
| 5,700,180 | A | | 12/1997 | Sandhu et al. |
| 5,838,447 | A | | 11/1998 | Hiyama et al. |
| 5,899,792 | A | * | 5/1999 | Yagi ..... 451/6 |
| 5,949,927 | A | | 9/1999 | Tang |
| 5,964,643 | A | | 10/1999 | Birang et al. |
| 6,014,248 | A | * | 1/2000 | Kobayashi et al. .... 359/337.13 |
| 6,093,081 | A | | 7/2000 | Nyui et al. |
| 6,108,092 | A | | 8/2000 | Sandhu |
| 6,146,248 | A | * | 11/2000 | Jairath et al. ..... 451/41 |
| 6,159,073 | A | | 12/2000 | Wiswesser et al. |
| 6,261,155 | B1 | | 7/2001 | Jairath et al. |
| 6,271,047 | B1 | * | 8/2001 | Ushio et al. ..... 438/14 |
| 6,280,289 | B1 | | 8/2001 | Wiswesser et al. |
| 6,358,130 | B1 | | 3/2002 | Freeman et al. |
| 6,425,801 | B1 | * | 7/2002 | Takeishi et al. ..... 451/5 |
| 6,466,642 | B1 | | 10/2002 | Meloni |
| 6,612,902 | B1 | | 9/2003 | Boyd et al. |

FOREIGN PATENT DOCUMENTS

| | | | |
|---|---|---|---|
| JP | 03-234467 | | 10/1991 |
| JP | 07-052032 | | 2/1995 |
| JP | 09-036072 | | 2/1997 |
| JP | 2001284299 A | * | 10/2001 |
| WO | WO 99/09371 | | 2/1999 |

OTHER PUBLICATIONS

Loctite; Technical Data Sheet; Product 401, May 2000.
Loctite; Technical Data Sheet; Product 770; May 2000.

* cited by examiner

*Primary Examiner*—Joseph J. Hail, III
*Assistant Examiner*—Anthony Ojini
(74) *Attorney, Agent, or Firm*—Fish & Richardson

(57) ABSTRACT

Methods and apparatus for monitoring a substrate surface during chemical mechanical polishing are disclosed.

53 Claims, 9 Drawing Sheets

SUBSTRATE MONITORING DURING CHEMICAL MECHANICAL POLISHING

TECHNICAL FIELD

This invention generally relates to chemical mechanical polishing of substrates, and more particularly to methods and apparatus for monitoring a substrate layer during chemical mechanical polishing.

BACKGROUND

An integrated circuit is typically formed on a substrate by the sequential deposition of conductive, semiconductive or insulative layers on a silicon wafer. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the carrier head configuration, the relative speed between the substrate and pad, and the force pressing the substrate against the pad.

In order to determine the effectiveness of different polishing tools and processes, a so-called "blank" wafer, i.e., a wafer with multiple layers but no pattern, is polished in a tool/process qualification step. After polishing, the remaining layer thickness is measured at several points on the substrate surface. The variation in layer thickness provide a measure of the wafer surface uniformity, and a measure of the relative polishing rates in different regions of the substrate. One approach to determining the substrate layer thickness and polishing uniformity is to remove the substrate from the polishing apparatus and examine it. For example, the substrate may be transferred to a metrology station where the thickness of the substrate layer is measured, e.g., with an ellipsometer. Unfortunately, this process can be time-consuming and thus costly, and the metrology equipment is costly.

One problem in CMP is determining whether the polishing process is complete, i.e., whether a substrate layer has been planarized to a desired flatness or thickness. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

One way to determine the polishing endpoint is to remove the substrate from the polishing surface and examine it. For example, the substrate may be transferred to a metrology station where the thickness of a substrate layer is measured, e.g., with an ellipsometer. If the desired specifications are not met, the substrate is reloaded into the CMP apparatus for further processing. This time consuming procedure reduces the throughput of the CMP apparatus. Alternatively, the examination might reveal that an excessive amount of material has been removed, rendering the substrate unusable.

There is, therefore, a need for a method of measuring in situ the thickness and flatness of the substrate layer, and detecting whether the desired thickness or flatness has been achieved.

Several methods have been developed for in-situ polishing endpoint detection. Most of these methods involve monitoring a parameter associated with the substrate surface, and indicating an endpoint when the parameter abruptly changes. For example, where an insulative or dielectric layer is being polished to expose an underlying metal layer, the coefficient of friction and the reflectivity of the substrate will change abruptly when the metal layer is exposed.

Where the monitored parameter changes abruptly at the polishing endpoint, such endpoint detection methods are acceptable. However, as the substrate is being polished, the polishing pad condition and the slurry composition at the pad-substrate interface may change. Such changes may mask the exposure of an underlying layer, or they may imitate an endpoint condition. Additionally, such endpoint detection methods will not work if only planarization is being performed, if the underlying layer is to be overpolished, or if the underlying layer and the overlying layer have similar physical properties.

SUMMARY

In general, in a first aspect, the invention features a method, including chemical-mechanical polishing a surface of a substrate, and selectively monitoring light from the surface of the substrate with a detector having a plurality of detector elements.

Embodiments of the method can include one or more of the following features and/or features of other aspects.

The method can include exposing a portion of the surface of the substrate with light.

At certain times during the method, light from the substrate surface can be monitored with a first detector element while light is not monitored with a second detector element.

The method can be used to perform endpoint analysis of an area of the surface of the substrate. The area can be a predefined area. In some embodiments, the area of the surface of the substrate is adjacent an edge of the substrate, such as within about 5 millimeters of the edge of the substrate (e.g., within about 4 millimeters, 3 millimeters, 2 millimeters, 1 millimeter). In some embodiments, the area of the surface of the substrate includes a center of the substrate center, such as within about 30 millimeters of the substrate center (e.g., within about 20 millimeters, 15 millimeters, 10 millimeters, 5 millimeters, 2 millimeters, 1. millimeter).

The method can be used to perform layer thickness analysis of at least one layer of the surface of the substrate.

Alternatively, or additionally, the method can be used to perform endpoint analysis of a layer of the surface of the substrate.

The chemical mechanical polishing can include bringing the surface of the substrate into contact with a polishing pad that has a window, and causing relative motion between the substrate and the polishing pad.

Selectively monitoring light can include simultaneously detecting light reflected from a plurality of regions on the surface of the substrate, and monitoring a plurality of intensity signals corresponding to the intensity of light reflected from the plurality of regions on the substrate surface. Selectively monitoring light can also include extracting a plurality of intensity measurements from each of the intensity signals, wherein each intensity measurement corresponds to a sampling zone in one of the regions on the substrate surface. In some embodiments, the method can further include determining a distance between each of the sampling zones and a reference location on the substrate surface. Selectively monitoring light can include selecting intensity measurements based on the distance between the sampling zones and the reference location, and the method further comprises computing a characteristic of the layer on the substrate from the selected intensities.

Selectively monitoring light from the surface of the substrate can include measuring a reflectance signal from each of the plurality of detector elements. Alternatively, or additionally, selectively monitoring light from the surface of the substrate comprises measuring an interference signal from each of the plurality of detector elements.

In another aspect, the invention features a method, including chemical-mechanical polishing a surface of a substrate, and monitoring light from the surface of the substrate with a detector having a plurality of detector elements, wherein, at certain times during the method, light from the substrate surface is monitored with a first detector element and light is not monitored with a second detector element.

Embodiments of the method can include one or more of the following features and/or features of other aspects.

The method can be used to perform endpoint analysis of an area of the surface of the substrate. In some embodiments, the area of the surface of the substrate is adjacent to an edge of the substrate. The area of the surface of the substrate can include a center of the substrate center.

The method can be used to perform layer thickness analysis of at least one layer of the surface of the substrate. Alternatively, or additionally, the method can be used to perform endpoint analysis of a layer of the surface of the substrate.

The chemical mechanical polishing can include bringing the surface of the substrate into contact with a polishing pad that has a window, and causing relative motion between the substrate and the polishing pad.

Monitoring light can include simultaneously detecting light reflected from a plurality of regions on the surface of the substrate, and monitoring a plurality of intensity signals corresponding to the intensity of light reflected from the plurality of regions on the substrate surface. Monitoring light can further include extracting a plurality of intensity measurements from each of the intensity signals, wherein each intensity measurement corresponds to a sampling zone in one of the regions on the substrate surface. The method can further include determining a distance between each of the sampling zones and a reference location on the substrate surface. Monitoring light can also include selecting intensity measurements based on the distance between the sampling zones and the reference location, and the method further comprises computing a characteristic of the layer on the substrate from the selected intensities.

In a further aspect, the invention features a method for measuring a characteristic of a layer on a substrate during chemical mechanical polishing. The method includes: (i) bringing a surface of the substrate into contact with a polishing pad that has a window; (ii) causing relative motion between the substrate and the polishing pad; (iii) directing a light beam through the window, the motion of the polishing pad relative to the substrate causing the light beam to move in a path across the substrate surface; (iv) simultaneously detecting light reflected from a plurality of regions in the path on the on the substrate surface; (v) monitoring a plurality of intensity signals corresponding to the intensity of light reflected from the plurality of regions in the path on the substrate surface; (vi) extracting a plurality of intensity measurements from each of the intensity signals, each intensity measurement corresponding to a sampling zone in one of the regions in the path across the substrate surface; (vii) determining a distance between each of the sampling zones and a reference location on the substrate surface; (viii) selecting intensity measurements based on the distance between the sampling zones and the reference location; and (ix) computing the characteristic of the layer on the substrate from the selected intensities.

Embodiments of the method can include one or more of the following features and/or features of other aspects.

Step (ix) can include integrating the selected intensities to obtain a region-of-interest reflectance value. Alternatively, or additionally, step (ix) can include generating a reflectance profile of a region of interest of the substrate surface from the selected intensities.

The selected intensities can correspond to sampling zones at or near the reference location. The reference location can be, for example, a center of the surface or an edge of the surface. The characteristic of the layer can be the substantial removal of the layer from the substrate.

The method can further include adjusting the relative motion between the substrate and the polishing pad based on the computed characteristic of the layer.

The light can be monitored using a detector array including a plurality of detector elements. In such cases, step (viii) can include selecting a first measurement corresponding to light detected by a first detector element at a particular time, and not selecting a second measurement corresponding to light detected by a different detector element at that particular time.

In another aspect, the invention features a substrate polishing system, including a polishing pad having an opening, a polishing head, a light source, an array of light detectors, and a controller for selectively monitoring the light detected by the array of light detectors. The polishing head is configured to hold a substrate adjacent the polishing pad during use of the system. The light source is configured so that, when the substrate is adjacent the polishing pad, the light source is capable of directing a light beam to an area of a surface of the substrate through the opening in the polishing pad. The array of light detectors is configured to detect light from the area of the surface. The light detectors are each configured to be capable of detecting light from a respective region of the area of the surface of the substrate.

Embodiments of the substrate polishing system can include one or more of the following features and/or features of other aspects.

During use of the apparatus, the controller can control one or more polishing parameters based upon the light monitored by the light detectors. Examples of polishing parameters include a rate of rotation of the polishing head and a rate of rotation of the polishing pad. The substrate polishing system can further include a dispenser configured to add a slurry to a surface of the polishing pad during use of the apparatus. In such embodiments, the amount of the slurry added to the surface of the polishing pad is another example of a polishing parameter. Where the substrate polishing system includes a pad conditioner in contact with a surface of the polishing pad, a further example of a polishing parameter is the pressure between the pad conditioner and the polishing pad surface. In some embodiments, the polishing head includes a retaining ring for securing the substrate during operation of the system, and the position of the retaining ring with respect to a surface of the polishing pad is another polishing parameter that the controller can control based upon the light monitored by the light detectors.

In another aspect, the invention features a substrate polishing system, including a polishing pad having an opening, a polishing head configured to hold a substrate adjacent the polishing pad during use of the system, a light source configured so that, when the substrate is adjacent the polishing pad, the light source is capable of directing a light beam to an area of a surface of the substrate through the opening in the polishing pad, an array of light detectors configured to detect light from the area of the surface, the light detectors each being configured to be capable of detecting light from a respective region of the area of the surface of the substrate, and a means for selectively monitoring the light detected by the array of light detectors.

Embodiments of the substrate polishing system can include one or more of the following features and/or features of other aspects.

During use of the substrate polishing system, the controller controls one or more polishing parameters based upon the light monitored by the light detectors. Examples of polishing parameters are listed above.

In another aspect, the invention features a method, including chemical-mechanical polishing a surface of a substrate, illuminating an area of the surface of the substrate with light from a light source, and monitoring light from the light source after the light interacts with the area of the surface of the substrate with a detector having at least two detector elements.

Embodiments of the method can include one or more of the following features and/or features of other aspects.

The monitoring can include selectively monitoring light from the light source after the light interacts with the area of the surface of the substrate. Selectively monitoring light can include simultaneously detecting light reflected from a plurality of regions on the surface of the substrate, and monitoring a plurality of intensity signals corresponding to the intensity of light reflected from the plurality of regions on the substrate surface.

The area of the surface of the substrate can be adjacent an edge of the substrate and/or can include a center of the substrate center.

The method can be used to perform layer thickness analysis of at least one layer of the surface of the substrate. Alternatively, or additionally, the method can be used to perform endpoint analysis of a layer of the surface of the substrate.

Selectively monitoring light from the surface of the substrate can include measuring an interference signal from each of the plurality of detector elements.

In a further aspect, the invention features a substrate polishing system, including a polishing pad having an opening, a polishing head, a light source, and at least two light detectors. The polishing head is configured to hold a substrate adjacent the polishing pad during use of the system. The light source is configured so that, when the substrate is adjacent the polishing pad, the light source is capable of directing a light beam to an area of a surface of the substrate through the opening in the polishing pad. The light detectors are configured to detect light from the light source after the light interacts with the area of the surface of the substrate.

Embodiments of the substrate polishing system can include one or more of the following features and/or features of other aspects.

The light detectors can each be configured to detect light from a respective region of the area of the surface of the substrate. The light detectors can be configured as an array.

The substrate polishing system can include a controller for selectively monitoring the light detected by the light detectors.

Embodiments of the invention may have one or more of the following advantages.

Embodiments of the invention can provide improved control of CMP. Embodiments can provide, for example, more accurate endpoint detection, improved signal to noise ratio when measuring the reflectance from a particular region of interest on a substrate surface, improved edge detection and exclusion, identification of different features on a substrate surface during CMP, and/or control over polishing rates at different regions of a substrate surface.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
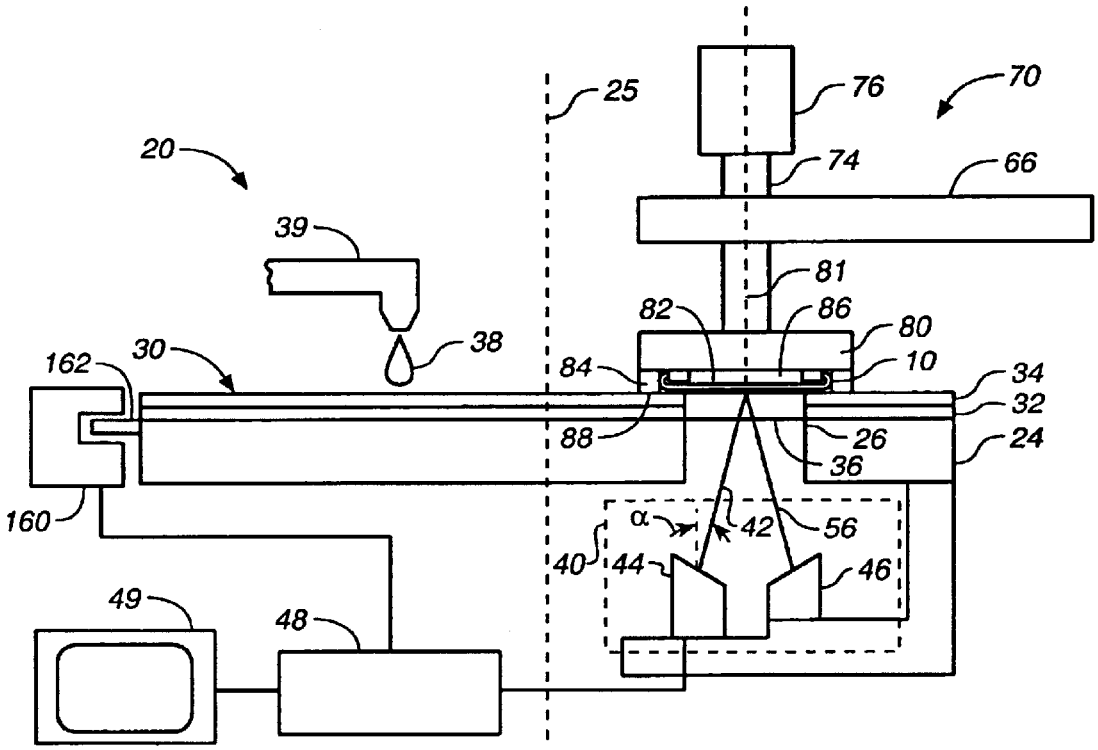
FIG. 1 is a side view of a chemical mechanical polishing (CMP) apparatus including an optical monitoring system.

Referring to FIG. 1, a substrate 10 is polished by a chemical mechanical polishing (CMP) apparatus 20. Descriptions of similar polishing apparatus may be found in U.S. Pat. No. 5,738,574 and U.S. Pat. No. 6,159,073, the entire disclosures of which are incorporated herein by reference. Polishing apparatus 20 includes a rotatable platen 24 on which is placed a polishing pad 30. If substrate 10 is an "eight-inch" (200 millimeter) or "twelve-inch" (300 millimeter) diameter disk, then the platens and polishing pads will be about twenty inches or thirty inches in diameter, respectively. Platen 24 is connected to a platen drive motor (not shown). For most polishing processes, the platen drive motor rotates platen 24 about its central axis 25 at thirty to two hundred revolutions per minute, although lower or higher rotational speeds may be used.

Polishing pad 30 has a backing layer 32 which abuts the surface of platen 24 and a covering layer 34 which is used to polish substrate 10. Covering layer 34 is typically harder than backing layer 32. However, some pads may have only a covering layer and no backing layer. Covering layer 34 may be composed of an open cell foamed polyurethane or a sheet of polyurethane with a grooved surface. Backing layer 32 may be composed of compressed felt fibers leached with urethane. A two-layer polishing pad, with the covering layer composed of IC-1000 and the backing layer composed of SUBA-4is available from Rodel, Inc., of Newark, Del. (IC-1000 and SUBA-4 are product names of Rodel, Inc.).

CMP apparatus 20 may further include an associated pad conditioner apparatus (not shown) to maintain the abrasive condition of the polishing pad.

Polishing apparatus 20 includes a head system 70, which includes a carrier or carrier head 80. A carrier drive shaft 74 connects a carrier head rotation motor 76 to carrier head 80 so that the carrier head can independently rotate about its own central axis 81. In addition, during operation carrier head 80 laterally oscillates towards and away from platen rotation axis 25.

The carrier head 80 performs several mechanical functions. Generally, the carrier head holds substrate 10 against the polishing pad, evenly distributes a downward pressure across the back surface of the substrate, transfers torque from the drive shaft to the substrate, and ensures that the substrate does not slip out from beneath the carrier head during polishing operations.

Carrier head 80 may include a flexible membrane 82 that provides a mounting surface for substrate 10, and a retaining ring 84 to retain the substrate beneath the mounting surface. Pressurization of a chamber 86 defined by flexible membrane 82 forces the substrate against the polishing pad. Retaining ring 84 may be formed of a highly reflective material, or it may be coated with a reflective layer to provide it with a reflective lower surface 88. A description of a similar carrier head 80 may be found in U.S. Pat. No. 6,183,354, entitled a CARRIER HEAD WITH a FLEXIBLE MEMBRANE FOR a CHEMICAL MECHANICAL POLISHING SYSTEM, dated Feb. 6, 2001, by Steven M. Zuniga et al., assigned to the assignee of the present invention, the entire disclosure of which is incorporated herein by reference.

A slurry 38 containing a reactive agent (e.g., deionized water for oxide polishing) and a chemically-reactive catalyzer (e.g., potassium hydroxide for oxide polishing) may be supplied to the surface of polishing pad 30 by a slurry supply port or combined slurry/rinse arm 39. If polishing pad 30 is a standard pad, slurry 38 may also include abrasive particles (e.g., silicon dioxide for oxide polishing).

In operation, the platen is rotated about its central axis 25, and the carrier head is rotated about its central axis 81 and translated laterally across the surface of the polishing pad.

A hole 26 is formed in platen 24 and a transparent window 36 is formed in a portion of polishing pad 30 overlying the hole. Transparent window 36 may be constructed as described in U.S. Pat. No. 5,893,796, entitled FORMING A TRANSPARENT WINDOW IN A POLISHING PAD FOR A CHEMICAL MECHANICAL POLISHING APPARATUS by Manoocher Birang, et al., granted Apr. 13, 1999, and assigned to the assignee of the present invention, the entire disclosure of which is incorporated herein by reference. Hole 26 and transparent window 36 are positioned such that they have a view of substrate 10 during a portion of the platen's rotation, regardless of the translational position of the carrier head.

An optical monitoring system 40 is secured to platen 24 beneath hole 26, and rotates with the platen. Optical monitoring system 40 includes a light source 44 and a detector 46. The light source generates a light beam 42 which propagates through transparent window 36 and slurry between the window and substrate, to impinge upon the exposed surface of substrate 10. For example, the light source 44 may be laser and the light beam 42 may be a collimated laser beam. The light laser beam 42 is projected from laser 44 at an angle $\alpha$ from an axis normal to the surface of substrate 10, i.e., at an angle a from axes 25 and 81. In addition, if the hole 26 and window 36 are elongated, a beam expander (not illustrated) may be positioned in the path of the light beam to expand the light beam along the elongated axis of the window.

Detector 46 is a detector array, positioned so that different array elements detect light reflected from different portions of the substrate surface. In other words, detector 46 spatially differentiates light reflected from the substrate surface. The intensity of light detected at detector 46 depends on, e.g., the composition of the wafer surface, wafer surface smoothness, and/or the amount of interference between light reflected from different interfaces of one or more layers (e.g., dielectric layers) on the wafer.

In general, detector 46 can include any elements capable of detecting illumination at the wavelength of light emitted from laser 44. For example, if the light emitted from laser 44 is in the visible spectrum (e.g., between about 0.4 microns and 0.7 microns) then detector 46 can be an array of photodiodes or a CCD array. Examples of other suitable wavelengths include those in the ultraviolet or infrared spectral regions. Infrared wavelengths can include those from about 700 nm to 2,000 nm or more (e.g., 780 nm, 785 nm, 790 nm, 808 nm, 830 nm, 1310 nm, and 1550 nm). Ultraviolet wavelengths include wavelengths below about 400 nm, such as in the 370–380 nm range.

In some embodiments, an array of optical waveguides (e.g., a fiber optic array) can be secured to platen 24, and can guide light reflected from substrate 10 to a detector positioned at some location remote from platen 24.

Figure 2A:
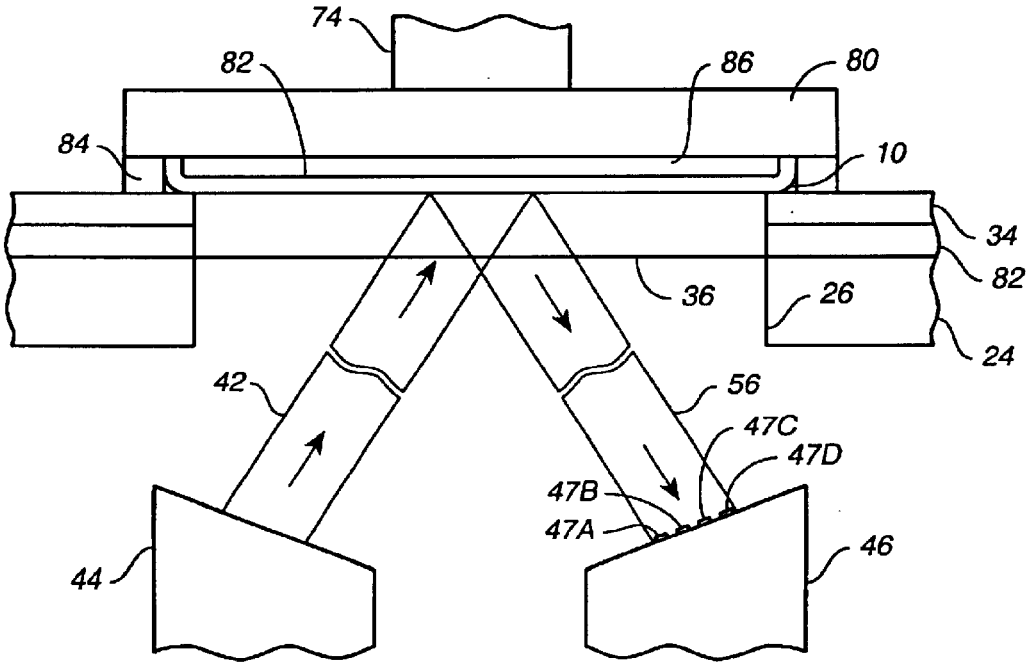
FIG. 2A is a side view of the optical monitoring system and part of the CMP apparatus shown in FIG. 1.
Figure 2B:
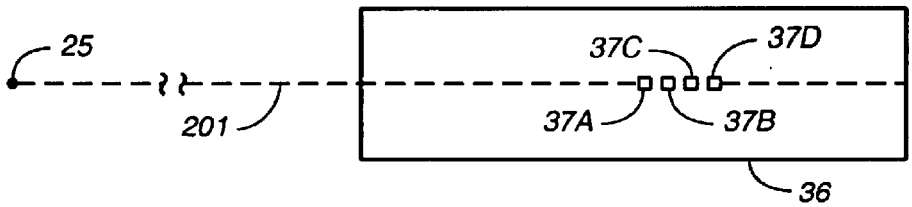
FIG. 2B is a plan view showing the window in the CMP apparatus shown in FIG. 1.
Figure 3A:
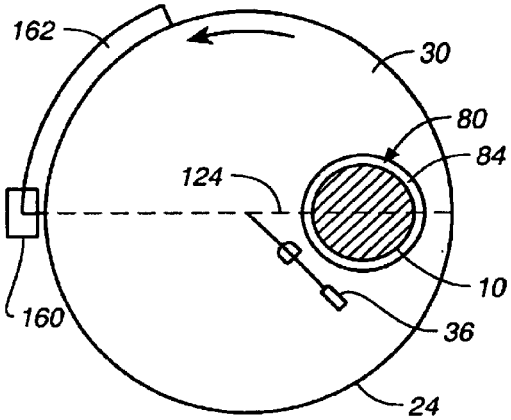
FIG. 3A-FIG. 3E are simplified plan views illustrating the position of the window in a polishing pad as a platen rotates.
Figure 3B:
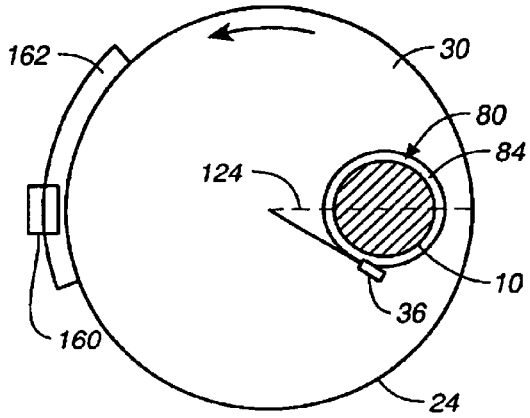
Figure 3C:
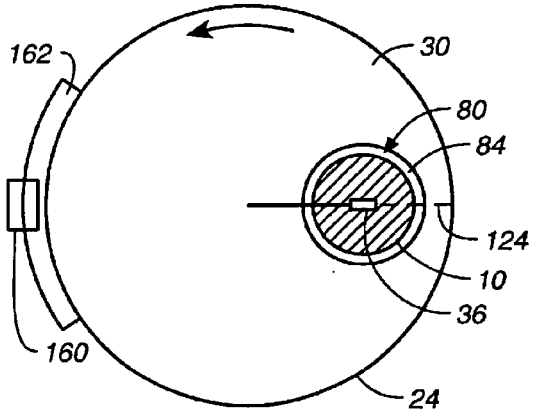
Figure 3D:
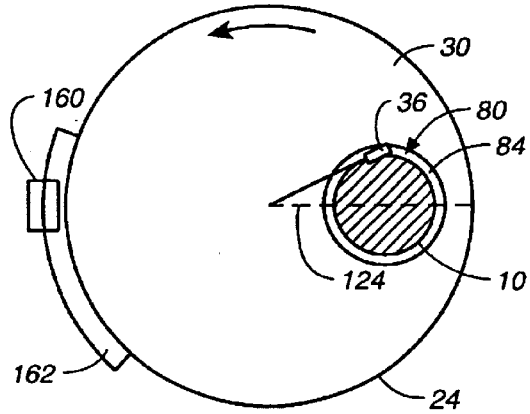
Figure 3E:
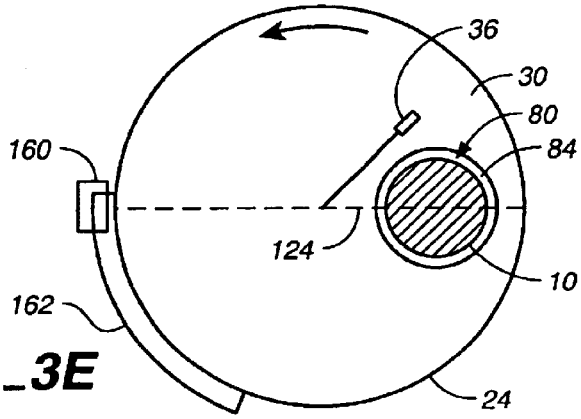

Array elements of detector 46 can be arranged in any geometric configuration so that at least some of the elements in the array can detect light reflected from a region of interest on the substrate surface (e.g., an area corresponding to the center of the surface or adjacent the edge of the surface). In some embodiments, detector 46 includes a two-dimensional detector array, such as a square or hexagonal array. Referring to FIG. 2A and FIG. 2B, in preferred embodiments, detector 46 includes a linear array of detector elements 47A, 47B, 47C, and 47D. Detectors 47A, 47B, 47C, and 47D detect light reflected from substrate 10 adjacent zones 37A, 37B, 37C, and 37D on the surface of window 36, respectively. The detector elements are positioned so that zones 37A, 37B, 37C, and 37D are oriented in a radial direction 201 with respect to central axis 25 of platen 24. In the described embodiment, detector 46 includes four detector elements. In general, however, the detector can have any number of elements, such as more than four elements (e.g., more than 10 elements, more than 100 elements, such as 1000 elements or more). In some embodiments, the detector has 1024 elements.

Laser 44 may operate continuously. Alternately, the laser may be activated to generate laser beam 42 during a time when hole 26 is generally adjacent substrate 10. Referring to FIGS. 1 and 3A–3E, CMP apparatus 20 may include a position sensor 160, such as an optical interrupter, to sense when window 36 is near the substrate. For example, the optical interrupter could be mounted at a fixed point opposite carrier head 80. A flag 162 is attached to the periphery of the platen. The point of attachment and length of flag 162 is selected so that it interrupts the optical signal of sensor 160 from a time shortly before window 36 sweeps beneath carrier head 80 to a time shortly thereafter. The output signal from detector 46 may be measured and stored while the optical signal of sensor 160 is interrupted.

For compatibility with the endpoint detection techniques discussed in U.S. Pat. No. 5,893,796, the flag 162 may have regions of differing widths, and position sensor 160 could have multiple optical interrupters. One interrupter would be used for process characterization using monitor wafers discussed below, and the other interrupter would be used for endpoint detection during polishing of product wafer.

Figure 4A:
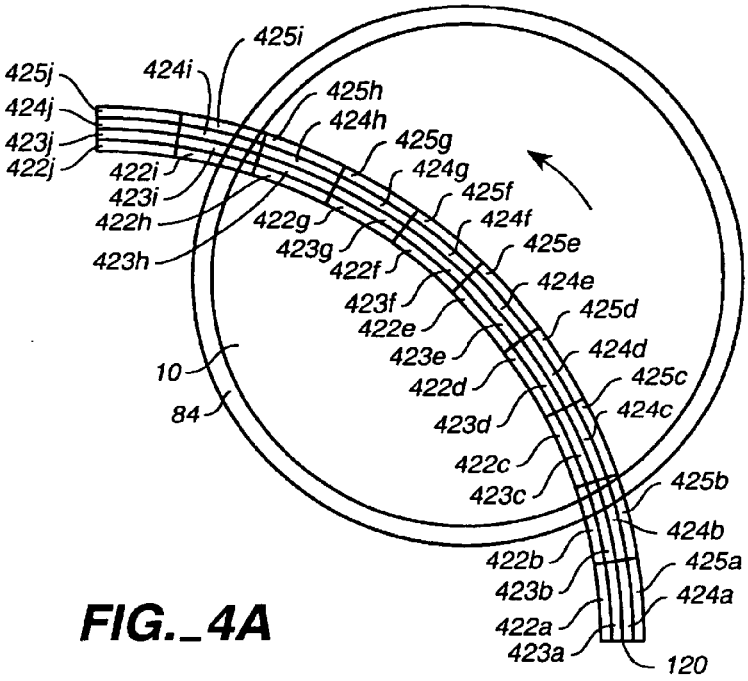
FIG. 4A is a schematic view illustrating the path of a laser beneath the carrier head.

Referring to FIG. 4A, the combined rotation of the platen and the linear sweep of the carrier head causes window 36 (and thus laser beam 42) to sweep across the bottom surface of carrier head 80 and substrate 10 in a sweep path 120. As the laser beam sweeps across the substrate, the detector array elements integrate the measured intensity over a sampling period, $T_{sample}$, to generate a series of individual intensity measurements $I_{1a}, I_{1b}, \ldots, I_{2j}, I_{3a}, \ldots, I_{3j}, I_{4a}, I_{4j}$. The sample rate F (the rate at which each detector element generates an intensity measurement) of optical monitoring system 40 is given by $F=1/T_{sample}$. Optical monitoring system 40 may have a sample rate between about 10 and 10,000 Hertz (Hz), corresponding to a sampling period between about 0.1 and 100 milliseconds. Specifically, optical monitoring system 40 may have a sampling rate of about 100 Hz and a sampling period of about 1 millisecond.

Thus, each time that laser 44 is activated, each detector element of detector 46 detects light reflected from a number of sampling zones. In the described embodiment, detector element 47*a* , detects light reflected from sampling zones 422*a*–422*j*. Similarly, detectors 47*b*47*b*, and 47*c* detect light reflected from sampling zones 423*a*–23*j*424*a*–424*j*, and 425*a*–125*j*, respectively. In summary, optical monitoring system 40 generates a series of intensity measurements $I_{\gamma a}$, $I_{\gamma b}, \ldots, I_{\gamma j}$ for each detector element ($\gamma$ is the index of the detector element), corresponding to that element's sampling zones.

The azimuthal resolution of each sampling zone depends on the sampling period, the rotational velocity of the platen, and the radial position of the substrate center. The azimuthal resolution can be less than about five millimeters (e.g., less than about one millimeter, 0.5 millimeters, 0.1 millimeters). The radial resolution of each element depends on the physical dimension of the element in the radial direction. The radial resolution can be less than about five millimeters (e.g., less than about one millimeter, 0.5 millimeters, 0.1 millimeters). In some embodiments, the radial resolution is approximately equal to the azimuthal resolution.

Although FIG. 4A illustrates ten sampling zones for each detector element, each element could detect light from more or fewer zones, depending on the platen rotation rate and the sampling rate. Specifically, a lower sampling rate will generally result in fewer, wider sampling zones, whereas a higher sampling rate will generally result in a greater number of narrower sampling zones. Similarly, a lower rotation rate will result in a larger number of narrower sampling zones, whereas a higher rotation rate will result in a lower number of wider sampling zones.

Figure 4B:
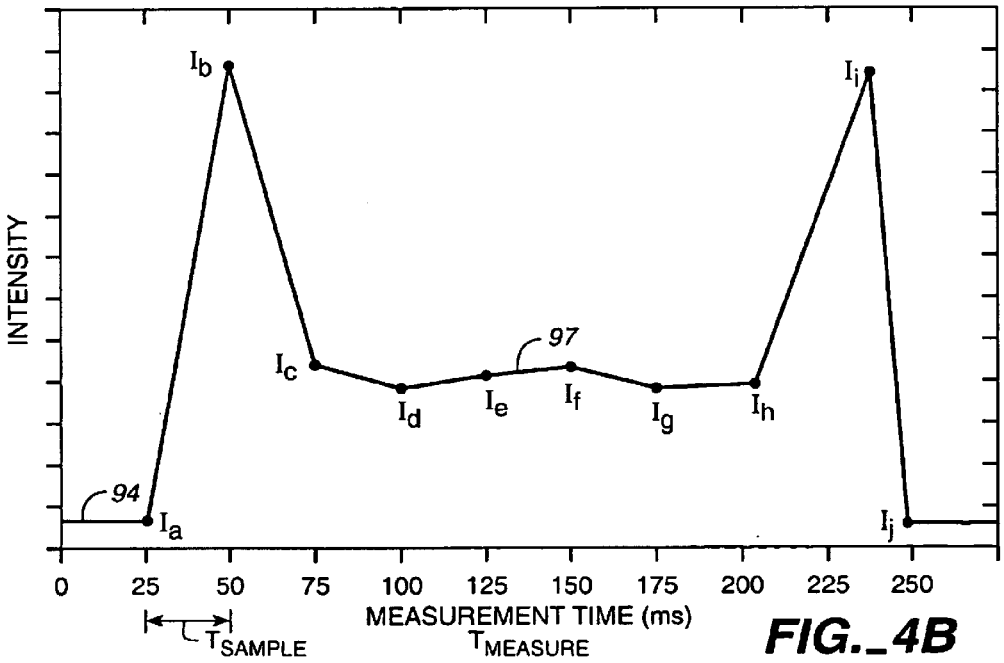
FIG. 4B is a graph showing a hypothetical portion of a reflectance trace generated by a single detector array element during a single sweep of the window beneath the carrier head.

Referring to FIG. 4B, each element provides a trace corresponding to the reflected light intensity from the zones sampled by that element. The intensity detected by each element can vary from zone to zone depending on the presence or absence of the wafer and/or retaining ring in the sampled zone. When the zone corresponds to the surface of the wafer, the detected reflectance can also depend on the composition of the wafer surface. For example, the intensity measurements $I_{1a}$ and $I_{1j}$ for sampling zones 422*a* and 422*j*, respectively, are low because window 36 does not have a view of the carrier head, and consequently laser beam 42 is not reflected. Part of sampling zones 422*b* and 422*i* are located beneath retaining ring 84, and intensity measurements $I_{1b}$ and $I_{1i}$ are relatively large because the retaining ring is formed from a highly reflective material. Sampling zones 422*c*, 422*d*, . . . , 422*h* are located beneath the substrate, and consequently generate intensity measurements $I_{1c}, I_{1d}, \ldots, I_{1h}$ of intermediate intensity at a variety of different radial positions across the substrate. These intensity measurements can depend upon the thickness of a thin film layer present on the wafer surface. Each detector in the detector array produces a similar trace to the one shown in FIG. 4B.

Figure 5:
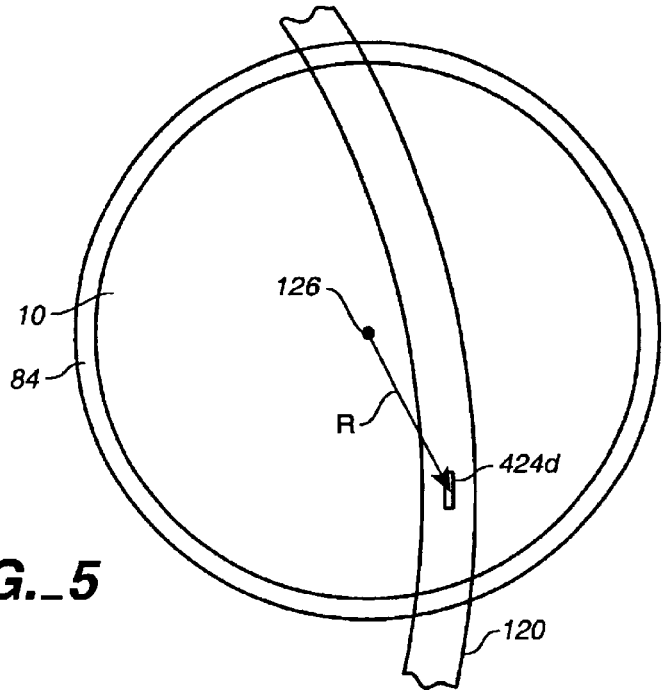
FIG. 5 is a schematic view illustrating the radial position of a sampling zone in the path of the laser.

Computer 48 determines the radial position each of the sampling zones with respect to the substrate center 126. A description of methods for determining the radial position of an exemplary sampling zone follows. The same methods can be used to determine the position of each sampling zone in a sweep. Referring to FIG. 5, the radial position of a sampling zone 424d in sweep path 120 is indicated as R. One way to determine the radial position of a sampling zone is to calculate the position of the laser beneath the substrate based on the measurement time $T_{measure}$ and the platen rotation rate and carrier head sweep profile. Unfortunately, the actual platen rotation rate and carrier head sweep profile may not precisely match the polishing parameters. Therefore, a preferred method of determining the radial positions of the sampling zones is to first determine the time $T_{sym}$ for each detector element. $T_{sym}$ refers to the time at which laser beam 42 passes beneath a mid-line 124 (see FIG. 3C) of the substrate. Then the radial positions of the sampling zones are determined from the time difference between the measurement time $T_{measure}$ and the symmetric time $T_{sym}$.

One method of determining the symmetry time $T_{sym}$ is to average the times at which detected reflectance spikes due to the highly reflective retaining ring. However, this results in some uncertainty in $T_{sym}$ because the position of the sampling zone beneath the retaining ring is not known.

Figure 6A:
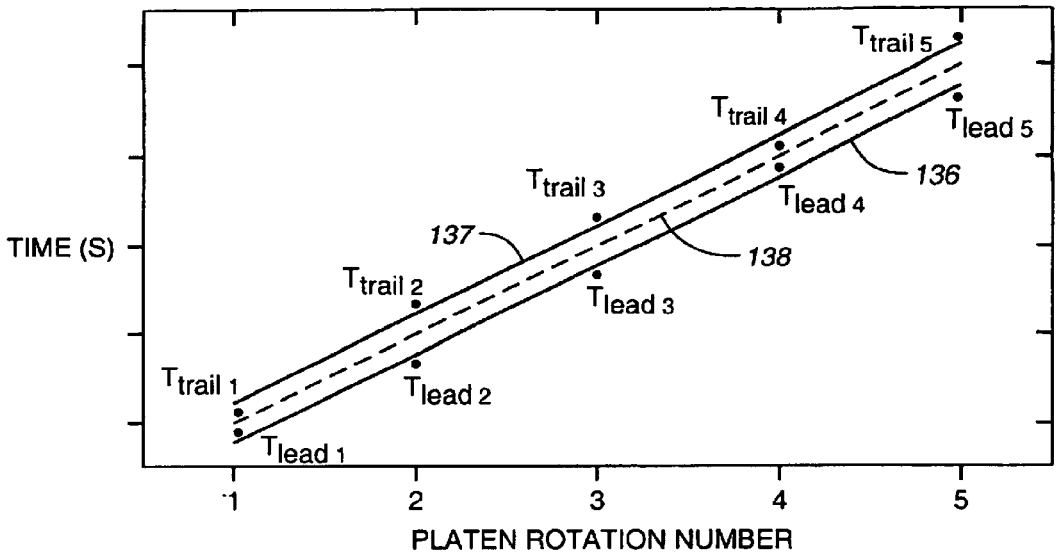
FIG. 6A is a graph showing the time at which a laser passes beneath a retaining of a carrier head as a function of the number of rotations of the platen.

Referring to FIG. 6A, in order to compute the symmetric time $T_{sym}$ for each detector element, computer 48 determines the first and last large intensity measurements from sweep path 120, e.g., intensity measurements $I_{lb}$ and $I_{li}$ for detector element 47A, and stores the corresponding measurement times $T_{lead}$ and $T_{trail}$. These lead and trail times $T_{lead}$ and $T_{trail}$ are accumulated on each sweep to generate a series of lead times, e.g., $T_{lead1}$, $T_{lead2}$, . . . , $T_{leadN}$ and trail times $T_{trail1}$, $T_{trail2}$, . . . , $T_{trailN}$, for each detector element. Computer 48 stores lead times $T_{lead1}$, $T_{lead2}$, . . . , $T_{leadN}$ for each detector element and the associate number of platen rotations 1, 2, . . . , N for each leading spike. Similarly, computer 48 stores the trail times $T_{trail1}$, $T_{trail2}$, . . . , $T_{trailN}$ for each detector element and the associated number of rotations 1, 2, . . . , N of each trailing spike. Assuming that platen 24 rotates at a substantially constant rate, the each element's times $T_{lead\ 1}$, $T_{lead\ 2}$, . . . , $T_{leadN}$ form a substantially linear increasing function (shown by line 136). Similarly, the times $T_{trail1}$, $T_{trail2}$, . . . , $T_{trailN}$ also form a substantially linear increasing function (shown by line 137). Computer 48 performs two least square fits to generate two linear functions, $T_{lead}(n)$ and $T_{trail}(n)$, for each detector element as follows:

$$T_{lead}(n)=a_1+(a_2*n)$$

$$T_{trail}(n)=a_3+(a_4*n)$$

where n is the number of platen rotations and $a_1$, $a_2$, $a_3$ and $a_4$ are fitting coefficients calculated during the least square fit. Once the fitting coefficients have been calculated, the symmetry time $T_{sym}$ at which laser beam 42 crosses mid-line 124 (shown by phantom line 138) may be calculated for each detector element as follows:

$$T_{sym}=\frac{a_1+a_3}{2}+\frac{a_2+a_4}{2}\times n.$$

By using a least square fit over several platen rotations to calculate the symmetry time $T_{sym}$, uncertainty caused by the differences in the relative position of the sampling zone beneath the retaining ring are substantially reduced, thereby significantly reducing uncertainty in the symmetry time $T_{sym}$.

Once computer 48 has calculated the time $T_{sym}$ at which laser beam 42 crosses midline 124, the radial distance of each sampling zone from substrate center 126 of the substrate are calculated.

Figure 6B:
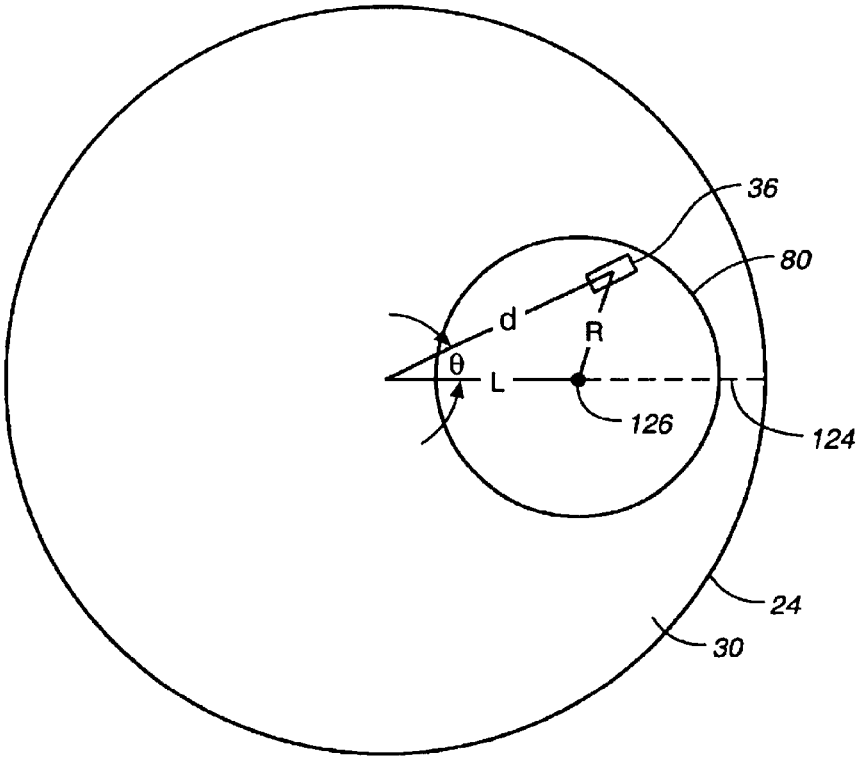
FIG. 6B is a schematic view illustrating the calculation of the radial position of a sampling zone.

Referring to FIG. 6B, the radial position may be calculated as follows:

$$R=\sqrt{d^2+L^2-2dL\cos\theta},$$

where d is the distance between the center of the polishing pad and the center of window 36, L is the distance from the center of the polishing pad to the center of substrate 10, and θ is the angular position of the window. The angular position θ of the window may be calculated as follows:

$$\theta=f_{platen}\times 2\pi(T_{measure}-T_{sym}).$$

where $f_{platen}$ is the rotational rate of the platen (in rpm). Assuming that the carrier head moves in a sinusoidal pattern, the linear position L of the carrier head may be calculated as follows:

$$L=L_0+A\cos(\omega\times T_{measure}),$$

where ω is the sweep frequency, A is the amplitude of the sweep, and $L_0$ is the center position of the carrier sweep.

In another embodiment, position sensor 160 could be used to calculate the time $T_{sym}$ when the window crosses midline 124. Assuming that sensor 160 is positioned opposite carrier head 80, flag 162 would be positioned symmetrically across from transparent window 36. The computer 48 stores both the trigger time $T_{start}$ when the flag interrupts optical beam of the sensor, and the trigger time $T_{end}$ when the flag clears the optical beam. The time $T_{sym}$ may be calculated as the average of $T_{start}$ and $T_{end}$.

In yet another embodiment, the platen and carrier head positions could be determined at each sample time $T_a$, $T_b$, . . . , $T_h$, from optical encoders connected to the platen drive motor and radial drive motor, respectively.

In some embodiments, midline 124 does not coincide with the center of flag 162. Any offset between midline 124 and the center of flag 162 can be corrected for by adding/subtracting an offset angle, q, which is the angular displacement of the flag midpoint measured from midline 124. The offset angle can be determined a priori for each platen/head combination. Using an offset angle has an advantage in that it can be independent of the platen rotation velocity.

Once the radial positions of the sampling zones have been calculated, some of the intensity measurement may be disregarded. If the radial position R of a sampling zone is greater than the radius of the substrate, then the intensity measurement for that sampling zone includes mostly radiation reflected by the retaining ring or background reflection from the window or slurry. Therefore, the intensity measurements for any sampling zone that is mostly beneath the retaining ring is ignored. This helps ensure that spurious intensity measurements are not used in the calculation of the thin film layer thickness.

Figure 7:
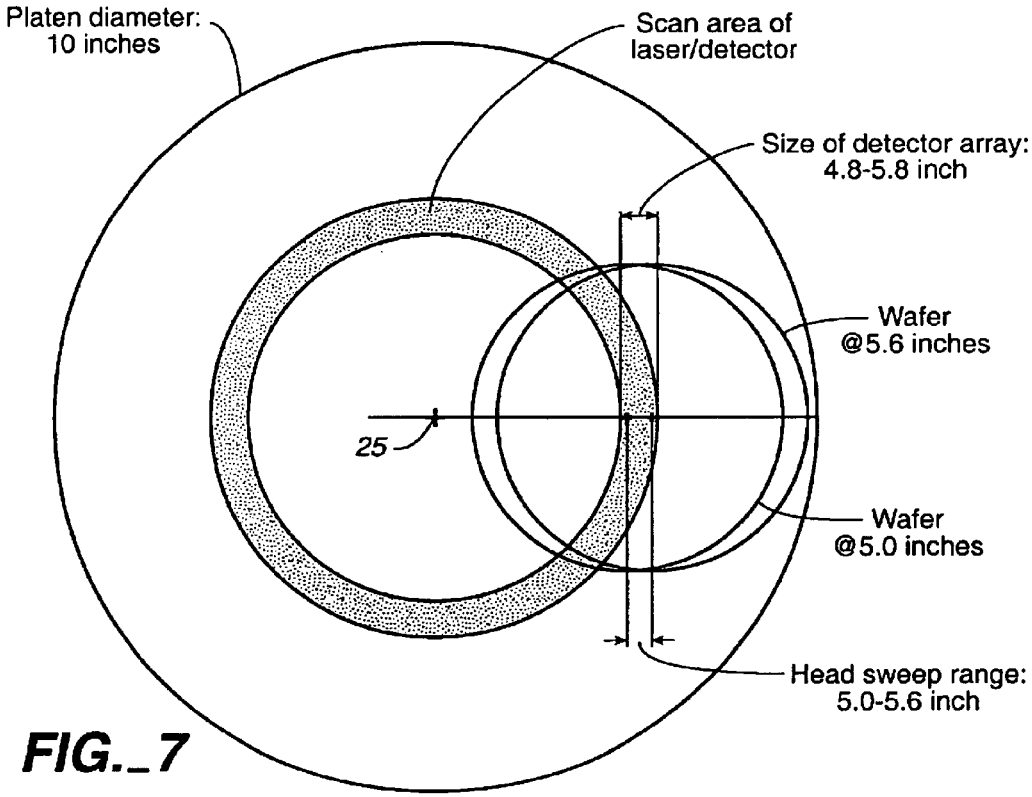
FIG. 7 is a schematic view showing the sweep range of a carrier head on the polishing pad.

In general, any subset of the sampling zone intensity measurements can be used in subsequent analysis. The subset of sampling zone intensity measurements defines a region of interest on the substrate surface for each scan. For example, computer 48 can select a region of interest to correspond to the center of the substrate (e.g., R □0). Referring to FIG. 7, in an exemplary system, depending on the position of the carrier head, the substrate center sweeps across the platen between 5.0 inches and 5.6 inches from platen central axis 25. An inch-long detector array is positioned with its innermost edge 4.8 inches from platen central axis 25. In this position, at least some elements of the detector array detect laser light reflected from the center the substrate each scan.

Figure 8A:
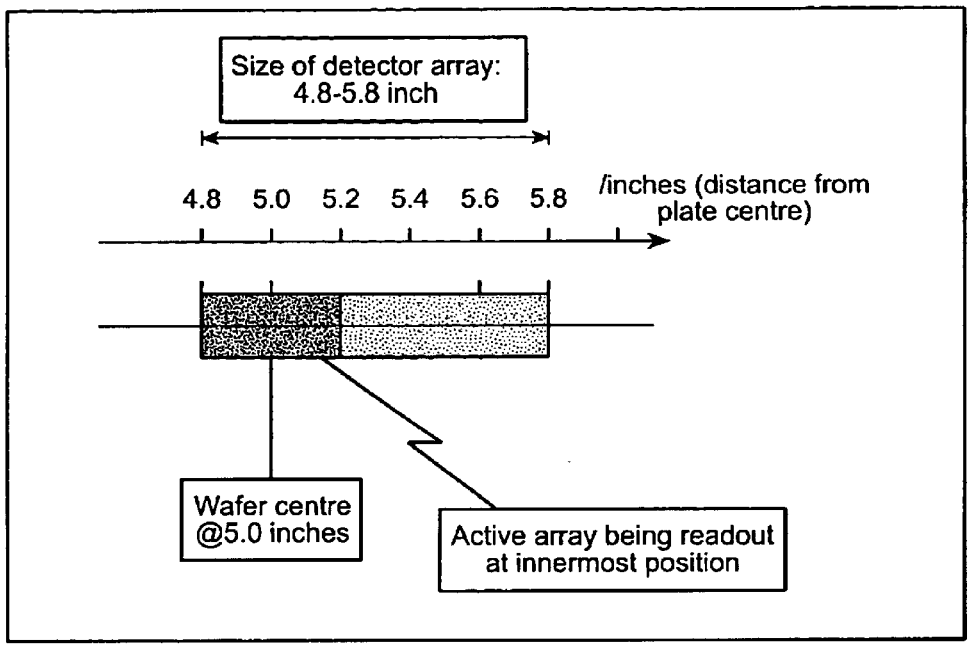
FIG. 8A and FIG. 8B are schematic views illustrating the position array elements used when measuring reflectance from a region of interest for different positions of the carrier head on the polishing pad surface.
Figure 8B:
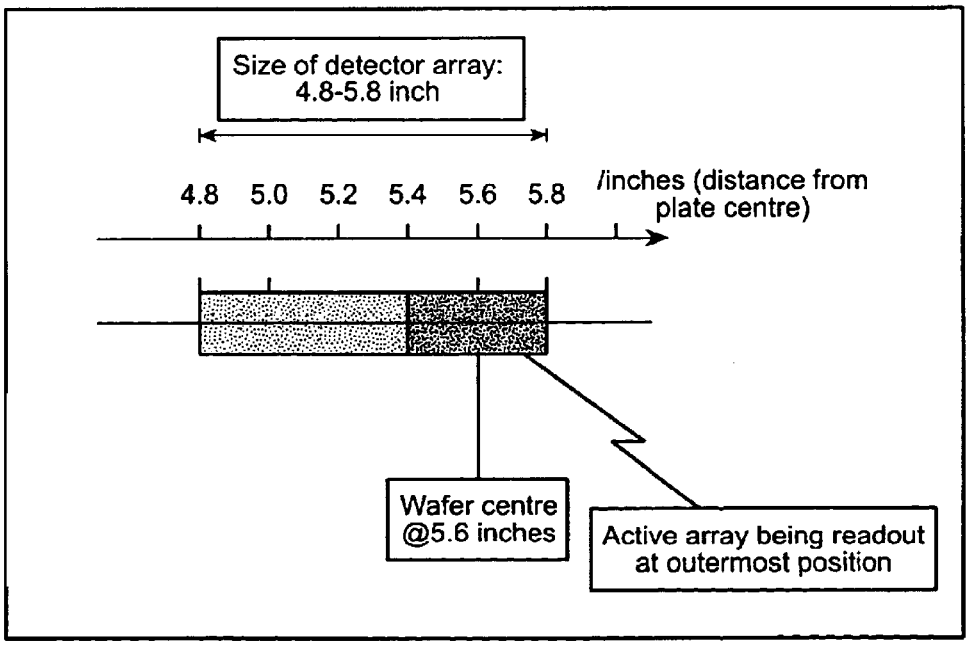

For a given scan, computer 48 retains only those intensity measurements corresponding to sampling zones sufficiently close the substrate center to be within the region of interest (e.g., within about 30 millimeters of the substrate center, such as within about 20 millimeters, 15 millimeters, 10 millimeters, 5 millimeters, 2 millimeters, 1 millimeter). Referring to FIG. 8A, when the substrate center is 5.0 inches from the platen rotation axis (innermost position), computer 48 retains only intensity measurements from the innermost array elements. Referring to FIG. 8B, conversely, when the substrate center is passes the platen window 5.6 inches from the platen rotation axis (outermost position), only intensity measurements from the outermost array elements are retained. When the substrate center passes the platen window at some intermediate position, the computer retains intensity measurements from appropriate array elements corresponding to a region of interest near the substrate center.

While the above description pertaining to FIG. 7 and FIGS. 8A and 8B refer to a particular embodiment, the concepts disclosed can be applied to other embodiments.

Figure 9:
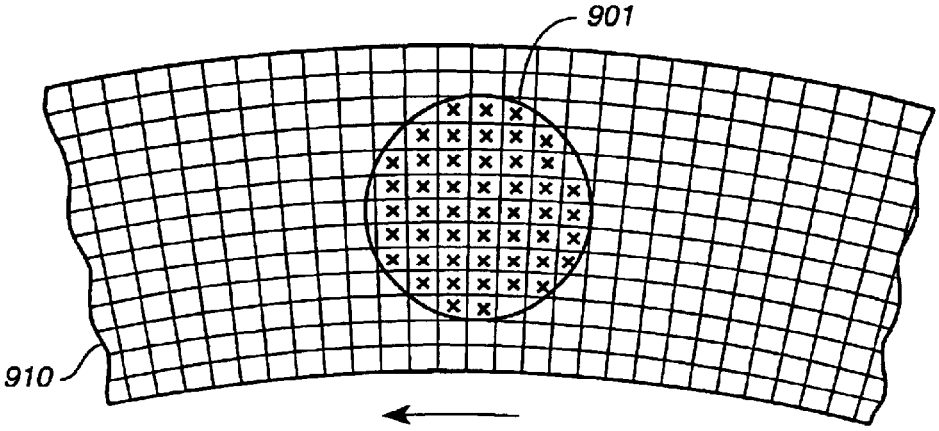
FIG. 9 is a schematic view showing sampling zones defining a circular region of interest.

Each scan, computer 48 can integrate the measured intensity of each sampling zone to obtain a single intensity value corresponding to the reflectance of the region of interest on the substrate surface. The shape of the region of interest can be chosen by selecting appropriate sampling zones to integrate over each scan. Referring to FIG. 9, a circular region of interest 901 can be selected by integrating over the sampling zones indicated by X's. In embodiments, regions of interest can be, for example, square, rectangular, linear, arcuate or oval.

Figure 10:
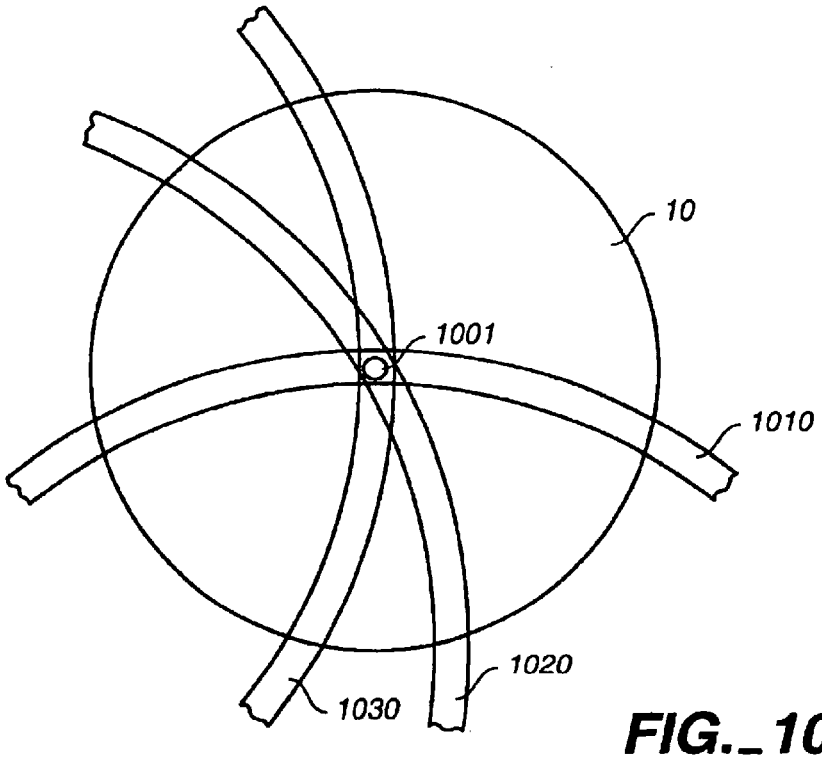
FIG. 10 is a schematic view illustrating how the same region of interest can be monitored for different sweep paths of the laser on the substrate surface.

The region of interest can be the same or different in different scans. In some embodiments, computer 48 selects the region of interest for different scans to correspond to the same portion of the substrate surface. Referring to FIG. 10, during three different scans the laser sweeps out three different trajectories 1010, 1020, and 1030 on the surface of substrate 10. For each scan, the computer selects the same circular region of interest 1001 corresponding to the center of the substrate surface.

Figure 11:
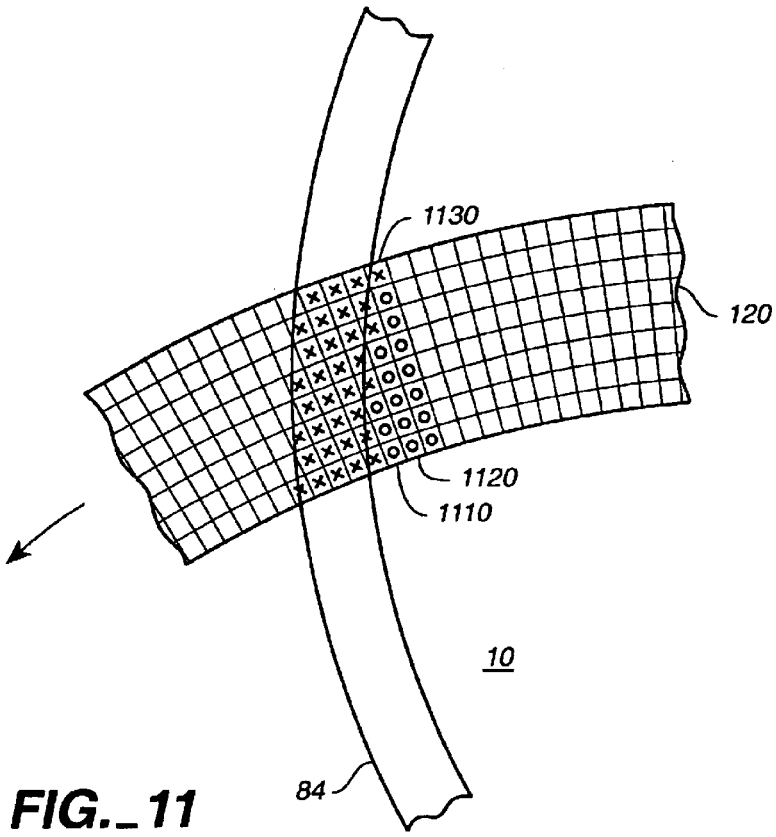
FIG. 11 a schematic view showing sampling zones defining a region of interest adjacent to the edge of the substrate surface.

In some embodiments, the region of interest can be near the edge of the wafer, adjacent retaining ring 84 (e.g., within about 5 millimeters of the edge of the wafer, such as within about 4 millimeters, 3 millimeters, 2 millimeters, 1 millimeter). Referring to FIG. 11, sampling zones labeled "X" correspond to retaining ring 84, while sampling zones labeled "O" correspond to the substrate surface near the edge of substrate 10. Due to the high reflectivity of the retaining ring, the measured reflectivity from the sampling zones X should be significantly higher than sampling zones O. When selecting a region of interest, computer 48 discards sampling zones X, while retaining zones O for further analysis.

By measuring the amount of light reflected from multiple parallel sampling zones during a sweep, computer 48 can discriminate between zones that correspond to the retaining ring and to the sample during each sampling period. For example, during three consecutive sampling periods, the system detects reflected light from sampling zones 1110, 1120, and 1130, respectively. Three zones are selected for the region of interest from zones 1110, six from 1120, and all eight from 1130. Thus, the region of interest closely follows the curved edge of the substrate.

Figure 12:
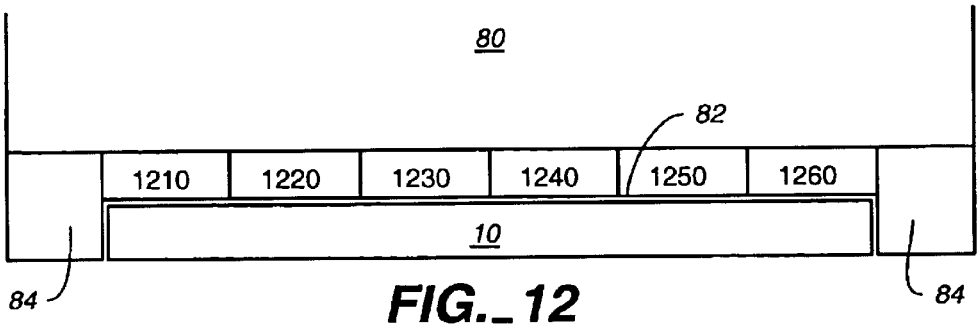
FIG. 12 is a side view of a carrier head including a comparmentalized chamber. Like reference symbols in the various drawings indicate like elements.

Referring to FIG. 12, in some embodiments, carrier head 80 can include a compartmentalized chamber, which can apply different pressures to regions of substrate 10 based on reflectance measurements from different regions of interest of the substrate surface. In the present embodiment, the chamber defined by flexible membrane 82 includes sub-chambers 1210, 1220, 1230, 1240, 1250, and 1260. The pressure inside each sub-chamber can be adjusted without substantially affecting the pressure in other sub-chambers. During operation, if a first region of the substrate surface is being polished at a faster rate than other regions, the pressure in the sub-chamber adjacent the first region can be reduced, thereby locally reducing the force between the surface and the polishing pad. This can slow the rate of polishing at the first region. For example, if the edge of the substrate surface is being polished too slowly, pressure in sub-chambers 1210 and 1260 can be increased. Conversely, if a second region is being polished too fast, the force between the surface and the polishing pad can be reduced by reducing pressure in the chamber adjacent the second region. For example, if the center portion of the substrate is being polished too fast, pressure in chambers 1230 and 1240 can be reduced to lessen the local polishing rate at the center.

Analysis of selected data can take many forms. For example, as described above, the intensity measured from each sampling zone in the region of interest can be summed (integrated) to provide a total reflected intensity for a region of interest each scan. The computer can compare the total reflected intensity from each scan to determine whether the substrate surface is sufficiently polished. Alternatively, or additionally, data analysis can include comparisons (e.g., by looking at the difference or ratio) of the reflected intensity from different sampling zones or groups of sampling zones. For example, lower and upper threshold intensities can be defined. Each pixel below the lower threshold contributes to a first signal (e.g., an endpoint signal) and/or each pixel above the upper threshold contributes to a second signal. A high intensity typically indicates a region on the wafer having a low density of material being removed (e.g., a dielectric layer), and a low intensity typically indicates a high density area.

In some embodiments, selected data can be used to develop an image of the substrate surface. During analysis, instead of integrating the detected light intensity from sampling zones over a region of interest, the intensity data from each sampling zone can be used to develop a reflectance profile of a region of the substrate surface. Each sampling zone datum can correspond to a pixel in the resulting image. This image can be analyzed to discriminate different features on the substrate surface (e.g., portions of different composition, such as a metal portion and an insulating portion). Extraneous data, such as pixels with intensity above or below a particular threshold, can be ignored from further analysis.

In some embodiments, data can be used for endpoint detection. The endpoint refers to the stage at which the polishing has sufficiently removed the unwanted material from the substrate surface. This can be characterized by a change in reflected intensity from a region of interest, as the material being removed may be more or less reflective than the underlying material.

In general, data can be used to control one or more operation parameters of the CMP apparatus. Operational parameters include, for example, platen rotational velocity, substrate rotational velocity, the polishing path of the substrate, the substrate speed across the plate, the pressure exerted on the substrate, slurry composition, slurry flow rate, and temperature at the substrate surface. Operational parameters can be controlled real-time, and can be automatically adjusted without the need for further human intervention.

While the foregoing description includes systems having a single light source, multiple (e.g., two, three, four, five, six, seven, eight, or more) light sources can be used.

A number of embodiments of the invention have been described. Nevertheless, it will be understood that various modifications may be made without departing from the spirit and scope of the invention

What is claimed is:

1. A method for polishing a surface of a substrate, comprising:

chemical-mechanical polishing the surface of the substrate; and monitoring light from the surface of the substrate with a detector having a plurality of detector elements including a first detector element and a second detector element;

wherein monitoring includes selectively using data from the first detector element collected in a first portion of the polishing step and disregarding data from the second detector element collected during the first portion of the polishing step so as to improve a signal to noise ratio of data from the detector.

2. The method of claim 1, further comprising exposing a portion of the surface of the substrate with light.

3. The method of claim 1, wherein exposing a portion of the surface includes directing light from a light source to the substrate.

4. The method of claim 1, further comprising performing endpoint analysis of an area of the surface of the substrate based on the selected data from the detector.

5. The method of claim 4, wherein the area is a predefined area.

6. The method of claim 4, wherein the area is within about 5 millimeters of the edge of the substrate.

7. The method of claim 4, wherein the area is within 30 millimeters of the substrate center.

8. The method of claim 1, further comprising performing layer thickness analysis of at least one layer of the surface of the substrate or endpoint analysis of a layer of the surface of the substrate based on the selected data from the detector.

9. The method of claim 1, wherein at least one detector element from the plurality of detector elements detects light reflected from a center of the substrate in a plurality of scans of the detector across the substrate.

10. The method of claim 1, wherein monitoring includes selectively using data from the first detector element and disregarding data from the second detector element collected during a scan in which the detector is moving relative to the substrate so as to monitor substantially the same portion of the substrate surface during two or more scans.

11. The method of claim 1, wherein polishing includes rotating a platen about a central axis and the detector elements are positioned radially with respect to the central axis.

12. The method of claim 11, wherein monitoring includes illuminating an area of the surface of the substrate with light from a light source, and rotation of the platen causes the area to sweep across the substrate.

13. The method of claim 1, further comprising adjusting one or more polishing parameters based upon the selected data.

14. The method of claim 13, wherein the polishing parameter includes one or more parameters selected from the group consisting of the rate of rotation of the polishing head, the pressure between the pad conditioner and the polishing pad surface, the position of the retaining ring with respect to a surface of the polishing pad, the substrate rotational velocity, the polishing path of the substrate, the substrate speed across the plate, the pressure exerted on the substrate, the slurry composition, the slurry flow rate, and the temperature at the substrate surface.

15. The method of claim 1, wherein monitoring includes selectively using data from the second detector element collected in a second portion of the polishing step and disregarding data from the first detector element collected during the second portion of the polishing step.

16. A method for polishing a surface of a substrate, comprising:

chemical-mechanical polishing the surface of the substrate; and selectively monitoring light from the surface of the substrate with a detector having a plurality of detector elements;

wherein selectively monitoring light comprises simultaneously detecting light reflected from a plurality of regions on the surface of the substrate, and monitoring a plurality of intensity signals corresponding to the intensity of light reflected from the plurality of regions on the substrate surface.

17. The method of claim 16, wherein selectively monitoring light further comprises extracting a plurality of intensity measurements from each of the intensity signals, wherein each intensity measurement corresponds to a sampling zone in one of the regions on the substrate surface.

18. The method of claim 17, further comprising determining a distance between each of the sampling zones and a reference location on the substrate surface.

19. The method of claim 18, wherein selectively using data further comprises selecting intensity measurements based on the distance between the sampling zones and the reference location, and the method further comprises computing a characteristic of the layer on the substrate from the selected intensities.

20. A method for polishing a surface of a substrate, comprising:

chemical-mechanical polishing the surface of the substrate; and selectively monitoring light from the surface of the substrate with a detector having a plurality of detector elements;

wherein selectively monitoring light from the surface of the substrate comprises measuring a reflectance signal from each of the plurality of detector elements.

21. A method for polishing a surface of a substrate, comprising:

chemical-mechanical polishing the surface of the substrate; and selectively monitoring light from the surface of the substrate with a detector having a plurality of detector elements;

wherein selectively monitoring light from the surface of the substrate comprises measuring an interference signal from each of the plurality of detector elements.

22. A method for polishing a surface of a substrate, comprising:

chemical-mechanical polishing the surface of the substrate; and monitoring light from the surface of the substrate with a detector having a plurality of detector elements including a first detector element and a second detector element, wherein the detector moves relative to the substrate to provide a plurality of scans of the substrate, wherein, monitoring includes selectively using data from the first detector element collected during a first portion of the polishing step and disregarding data from the second detector element collected during the first portion of the polishing state so as to monitor substantially the same portion of the substrate surface during two or more scans from the plurality of scans.

23. The method of claim 22, further comprising performing endpoint analysis of an area of the surface of the substrate or layer thickness analysis of at least one layer of the surface of the substrate based on selected data from the detector.

24. The method of claim 23, wherein the area of the surface of the substrate is adjacent an edge of the substrate or includes a center of the substrate center.

25. The method of claim 22, wherein monitoring includes selectively using data from the second detector element collected in a second portion of the polishing step and disregarding data from the first detector element collected during the second portion of the polishing step.

26. The method of claim 22, wherein polishing includes moving a polishing head that holds the substrate laterally across the polishing pad while the substrate is contacting the polishing pad.

27. A method for polishing a surface of a substrate, comprising:

chemical-mechanical polishing the surface of the substrate; and monitoring light from the surface of the substrate with a detector having a plurality of detector elements;

wherein, during at least a first portion of the polishing step, light from the substrate surface is monitored with a first deflector element and light is not monitored with a second detector element; and wherein monitoring light comprises simultaneously detecting light reflected from a plurality of regions on the surface of the substrate, and monitoring a plurality of intensity signals corresponding to the intensity of light reflected from the plurality of regions on the substrate surface.

28. The method of claim 27, wherein monitoring light further comprises extracting a plurality of intensity measurements from each of the intensity signals, wherein each intensity measurement corresponds to a sampling zone in one of the regions on the substrate surface.

29. The method of claim 28, further comprising determining a distance between each of the sampling zones and a reference location on the substrate surface.

30. The method of claim 29, wherein monitoring light further comprises selecting intensity measurements based on the distance between the sampling zones and the reference location, and the method further comprises computing a characteristic of the layer on the substrate from the selected intensities.

31. A method for measuring a characteristic of a layer on a substrate during chemical-mechanical polishing, the method comprising:

bringing a surface of the substrate into contact with a polishing pad that has a window;

causing relative motion between the substrate and the polishing pad;

directing a light beam through the window, the motion of the polishing pad relative to the substrate causing the light beam to move in a path across the substrate surface;

simultaneously detecting light reflected from a plurality of regions in the path on the on the substrate surface;

monitoring a plurality of intensity signals corresponding to the intensity of light reflected from the plurality of regions in the path on the substrate surface;

extracting a plurality of intensity measurements from each of the intensity signals, each intensity measurement corresponding to a sampling zone in one of the regions in the path across the substrate surface;

determining a distance between each of the sampling zones and a reference location on the substrate surface;

selecting intensity measurements based on the distance between the sampling zones and the reference location; and computing the characteristic of the layer on the substrate from the selected intensities.

32. The method of claim 31, wherein computing a characteristic of the layer comprises integrating the selected intensities to obtain a region-of-interest reflectance value.

33. The method of claim 31, wherein computing a characteristic of the layer comprises generating a reflectance profile of a region of interest of the substrate surface from the selected intensities.

34. The method of claim 31, wherein the selected intensities correspond to sampling zones at or near the reference location.

35. The method of claim 31, wherein the reference location is a center of the surface or an edge of the surface.

36. The method of claim 31, wherein the characteristic of the layer is the substantial removal of the layer from the substrate.

37. The method of claim 31, further comprising adjusting the relative motion between the substrate and the polishing pad based on the computed characteristic of the layer.

38. The method of claim 31, wherein the light is monitored using an detector array comprising a plurality of detector elements.

39. The method of claim 31, wherein selecting intensity measurements comprises selecting a first measurement corresponding to light detected by a first detector element at a particular time, and not selecting a second measurement corresponding to light detected by a different detector element at that particular time.

40. A substrate polishing system, comprising:

a polishing pad having an opening;

a polishing head configured to hold a substrate adjacent the polishing pad during use of the system;

a light source configured so that, when the substrate is adjacent the polishing pad, the light source is capable of directing a light beam to an area of a surface of the substrate through the opening in the polishing pad;

an array of light detectors configured to detect light from the area of the surface, the light detectors each being configured to be capable of detecting light from a respective region of the area of the surface of the substrate; and a controller for selectively monitoring the light detected by the array of light detectors.

41. The apparatus of claim 40, wherein, during use of the apparatus, the controller controls a polishing parameter based upon the light monitored by the light detectors.

42. A substrate polishing system, comprising:

a polishing pad having an opening;

a polishing head configured to hold a substrate adjacent the polishing pad during use of the system;

a light source configured so that, when the substrate is adjacent the polishing pad, the light source is capable of directing a light beam to an area of a surface of the substrate through the opening in the polishing pad;

an array of light detectors configured to detect light from the area of the surface, the light detectors each being configured to be capable of detecting light from a respective region of the area of the surface of the substrate; and a means for selectively monitoring the light detected by the array of light detectors.

43. A method for polishing a surface of a substrate, comprising:

chemical-mechanical polishing the surface of the substrate;

during polishing illuminating an area of the surface of the substrate with light from a light source; and monitoring light from the light source after the light interacts with the area of the surface of the substrate with a detector having a plurality of detector elements, each of the plurality of detector elements receiving light from a different portion of the area of the surface of the substrate illuminated by the same light source.

44. The method of claim 43, wherein the monitoring comprises selectively monitoring light from the light source after the light interacts with the area of the surface of the substrate.

45. The method of claim 43, wherein monitoring includes selectively using data from the first detector element collected in a first portion of the polishing step and disregarding data from the second detector element collected during the first portion of the polishing step and selectively using data from the second detector element collected in a second portion of the polishing step and disregarding data from the first detector element collected during the second portion of the polishing step so as to improve a signal to noise ratio of data from the detector.

46. The method of claim 45, wherein the platen rotates about a central axis and the detector elements are positioned radially with respect to the central axis of the platen.

47. A substrate polishing system, comprising:

a movable platen;

a polishing head configured to hold a substrate adjacent to a polishing pad during use of the system; and at least one optical monitoring system including a light source connected to the movable plater, wherein the a light source is configured so that, when the substrate is adjacent the polishing pad, the light source is configured to direct a light beam to an area of a surface of the substrate through the opening in the polishing pad during polishing and the optical monitoring system further including a detector having a plurality of light detector elements configured to detect light from different portions of the area illuminated by the same light source after the light interacts with the area of the surface of the substrate.

48. The method of claim 47, wherein light from a light source sweeps across the substrate as the platen moves.

49. The system of claim 47, wherein the opening comprises a solid transparent material.

50. A method for polishing a surface of a substrate, comprising:

chemical-mechanical polishing the surface of the substrate;

monitoring light from the surface of the substrate with a detector having a plurality of detector elements;

detecting a polishing endpoint, the detecting including (i) selecting a first measurement corresponding to light detected by a first detector element at a particular time, and (ii) excluding a second measurement corresponding to light detected by a different detector element at that particular time.

51. The method of claim 50, wherein excluding the second measurement improves the signal to noise ratio.

52. A substrate monitoring system, comprising:

a light source to illuminate a substrate during polishing;

a detector to detect light from the substrate, the detector including a plurality of detector elements including a first detector element and a second detector element; and a controller to receive data from the detector and configured to selectively use data from the first detector element collected in a first portion of the polishing step and disregard data from the second detector element collected during the first portion of the polishing step so as to improve a signal to noise ratio of data from the detector.

53. A substrate monitoring system, comprising:

a light source to illuminate a substrate during polishing;

a detector to detect light from the substrate, the detector including a plurality of detector elements including a first detector element and a second detector element; and a controller to receive data from the detector and configured to selectively use data from the first detector element collected in a first portion of the polishing step and disregard data from the second detector element collected during the first portion of the polishing step so as to improve a signal to noise ratio of data from the detector.

* * * * *